United States Patent [19]

Terrels

[11] Patent Number: 4,501,500

[45] Date of Patent: Feb. 26, 1985

[54] PAINT CUP FOR SPRAYER

[76] Inventor: Joseph L. Terrels, 111 S. Bolmar St., West Chester, Pa. 19380

[21] Appl. No.: 572,650

[22] Filed: Jan. 20, 1984

[51] Int. Cl.[3] ..... B01F 7/16; B01F 7/22

[52] U.S. Cl. ..... 366/250; 239/142; 366/605

[58] Field of Search ..... 366/129, 130, 247, 249, 366/250, 605; 239/142

[56] References Cited

U.S. PATENT DOCUMENTS 3,672,645 6/1972 Terrels et al. ..... 366/250

4,184,778 1/1980 Terrels ..... 366/250

*Primary Examiner*—Timothy F. Simone

*Attorney, Agent, or Firm*—Dann, Dorfman, Herrell and Skillman

[57] ABSTRACT

A paint cup adapted to be carried by a spray gun for use with coating materials requiring stirring to prevent separation. A reservoir is closed by a cover member which is mounted on the spray gun and, which in turn, mounts an agitator which projects into the reservoir. The agitator is driven by compressed air admitted to an impeller housing on the cover member. The reservoir is sealed except for means to introduce air to replace the coating material used in operation, and in this invention the air is introduced primarily through a separate check valve. Discharge ports in the impeller housing are made sufficiently large to assure at least atmospheric pressure in the reservoir. A separate check valve is provided to maintain the pressure within the reservoir at atmospheric pressure while preventing material leakage from the reservoir. The design of the cover assembly and its controls ensures easy flushing of the components with or without disassembly.

9 Claims, 4 Drawing Figures

PAINT CUP FOR SPRAYER

FIELD OF THE INVENTION

The present invention relates to a paint cup assembly for use with a conventional spray gun. The invention has particular application to a hand-held spray gun for use with coating material which requires stirring to prevent separation.

BACKGROUND OF THE INVENTION

The present invention is an improvement on my sprayer cup shown in U.S. Pat. No. 4,184,778.

In the use of the cup shown in my earlier patent and also cups of other designs, it has been found that under certain conditions there is a tendency for the contents of the cup to be ejected into and through the venting arrangement, causing spillage of the paint and possible clogging of the venting arrangement.

Furthermore, it was found that the design of the valving arrangement for controlling the impeller should be improved to reduce the cost of manufacture and assembly without sacrificing its favorable operating conditions.

SUMMARY OF THE INVENTION

With the foregoing in mind the present invention provides a paint cup assembly for a sprayer which is of simple construction and yet is fully effective in various modes of use.

More specifically the present invention provides means for agitating the contents of the paint cup while controlling the pressures within the paint cup to avoid problems which have appeared in the use of prior art devices.

More specifically the present invention provides a pressure controlling device which maintains the pressure within the cup reservoir within predetermined limits in a simple and effective manner.

The present invention also provides a paint cup assembly which is economical to produce and yet is fully effective in operation and is readily cleaned with or without disassembly of the parts thereof.

BRIEF DESCRIPTION OF THE DRAWINGS

All of the objects of the invention are more fully set forth hereinafter with reference to the accompanying drawing wherein.

DESCRIPTION OF THE PREFERRED EMBODIMENT

Figure 1:
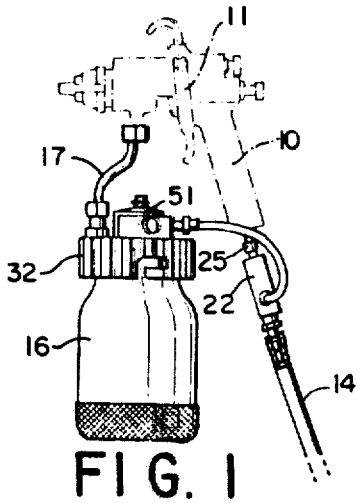
FIG. 1 is a thumb nail sketch of a paint cup assembly in accordance with the present invention showing a conventional hand-held sprayer in broken lines.
Figure 2:
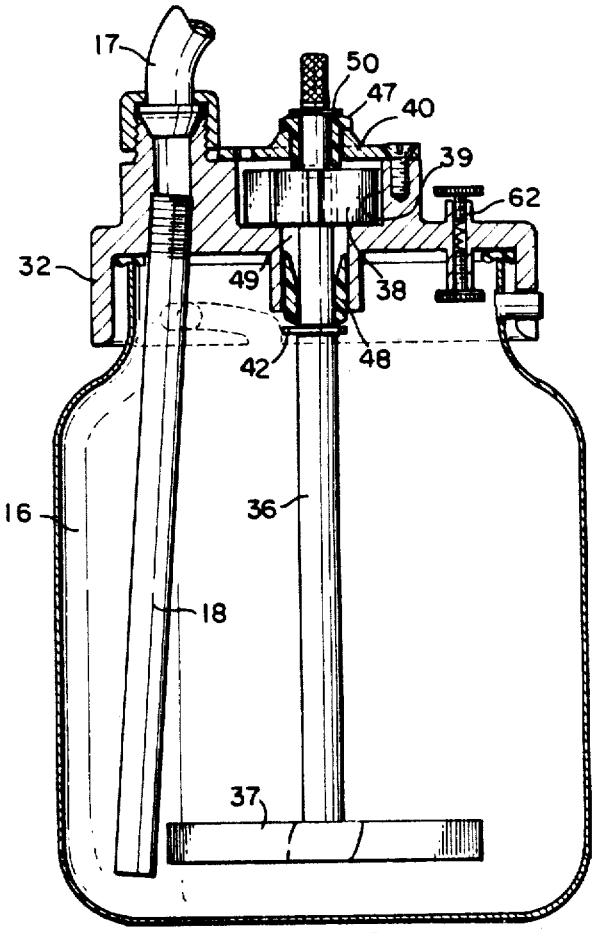
FIG. 2 is an enlarged vertical cross section through the paint cup assembly.

Referring now to the drawing, the spraying assembly of the present invention includes a spray gun 10 which may be of conventional form having a trigger mechanism 11 which is operable to control the flow of air through the gun. Air is supplied to the gun through an air line 14 having a manifold 22 associated therewith which may include a pressure gauge, if desired, and regulating valve (not shown) for regulating the flow and pressure of the air supplied to the gun. The paint cup assembly includes a reservoir 16 having a cover assembly 32. As shown in FIG. 2, the cover assembly 32 mounts an aspirator tube 18 and a rigid connecting tube 17 which serves to mount the cover assembly 32 on the spray gun as well as provides means for aspirating the paint in the cup through the tube 17 into the nozzle of the spray gun by action of the flow of compressed air therethrough. As the paint is discharged from the reservoir 16, air replaces the discharged paint to prevent any substantial reduction of pressure within the reservoir to below atmospheric pressure. To accommodate the flow of replacement air, a pressure regulating mechanism, 62 is provided as described more fully hereinafter, preferably diagonally spaced from the aspirator tube 18. Agitator means depends from the cover assembly into the reservoir 16 to stir the coating material contained in the cup reservoir, and is driven by impeller means in the cover assembly. The agitation of the contents may fill the air space in the reservoir with particles of the paint or other coating material. Since the flow through the regulating assembly 62 is inward, the particles do not normally enter the assembly, and if any particles should migrate into the assembly, they are cleared by the flow of air therethrough. It is noted that the pressure regulating device 62 excludes outward air flow therethrough. The manifold 22 has a branch conduit 25 leading to the cover assembly so that the compressed air from the air line 14 may be used to actuate the impeller means.

Figure 3:
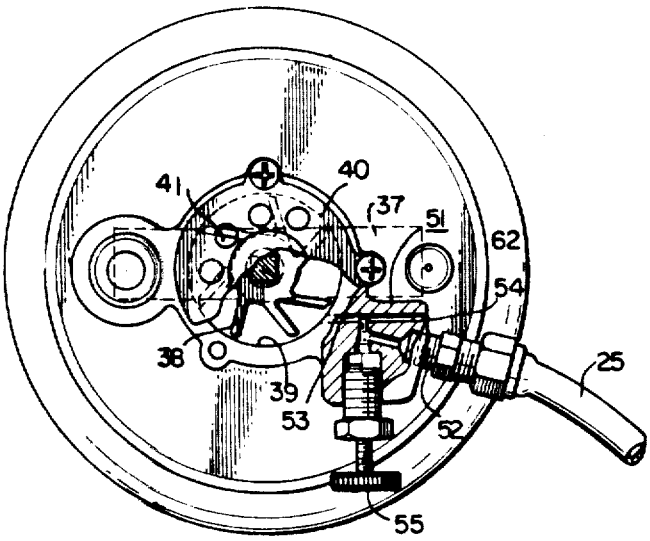
FIG. 3 is a plan view of the structure shown in FIG. 2 with portions broken away to more clearly illustrate the construction and operation thereof.

In the illustrated embodiment of the invention, the cover assembly 32 includes an impeller chamber 39 which, as shown in FIG. 3 is generally cylindrical and houses a vane-type impeller 38 for rotation about its cylindrical axis. In the present instance the impeller chamber 39 is formed integrally with the cover member having an open top which is covered by a cover plate 40 having a series of discharge orifices 41 extending through a semi-circular arc overlying the impeller chamber. The impeller is keyed to an agitator shaft 36 which is journaled in polymeric bushings or bearings 47 and 48. The bushing 47 is mounted in the cover plate 40 and the bushing 48 is mounted in a central bore 49 which affords communication between the reservoir 16 and the impeller chamber 39. As shown in FIG. 2, the agitator shaft 36 is provided with agitator blades 37 at its lower end, a fling wheel 42 in the form of a polymeric washer immediately below the bearing 48, and a releasable retainer 50 in the form of a C-ring disposed below the knurled upper end of the shaft 36. The knurled upper end of the shaft 36 permits manual rotation of the shaft independently of the impeller means, as needed.

As indicated in FIG. 3, the agitator shaft 36 has a square portion on which the impeller 38 is keyed so that rotation of the impeller 38 drives the shaft 36. The square portion of the shaft is smaller than cylindrical portion below it, so that disassembly of the shaft from the cover assembly is readily accomplished by removal of the retainer 50 and axial displacement of the shaft 36 downwardly through the bushings 47 and 48.

As discussed more fully hereinafter, the shaft 36 is mounted in the bushing 48 within the bore 49 with sufficient clearance to permit air flow between the chamber 39 and the reservoir 16. The fling wheel 42 extends outwardly from the shaft 36 to underlie the bushing 48 and prevent the coating material in the reservoir from splashing directly into the clearance space between the bushing and the shaft. The splashing is greatest at the time when the agitator shaft is rotating, and the rotation of the shaft causes the fling wheel 42 to rotate and assist in the deflection of paint from the clearance space. The polymeric composition of the washer 42 and the bushing 48 provides a relatively friction-free engagement limiting upward displacement of the shaft as the agitator blades 37 are rotated through the material and sweep the bottom of the reservoir. The C-ring 50 limits downward displacement.

The impeller 38 is driven by air supplied from the branch conduit 25 through the flow-regulating housing 51. The housing 51 has an inlet 52 for connection to the branch conduit 25 and an outlet jet 53 formed by a through bore in the housing 51 which is plugged at the outer end 54 by a removable plug, preferably threaded. Removal of the plug 54 permits the bore of the jet 53 to be easily cleared of any obstruction. Communication between the inlet 52 and the jet passageway 53 is through a needle valve assembly 55 which is clearly shown in FIG. 3. Regulating the needle valve permits control of the air flow through the jet 53 and the controlled flow correspondingly regulates the speed of rotation of the impeller 38 under the action of the air issuing from the jet 53. As shown, the discharge ports 41 are spaced from the entrance jet 35 so as to afford ample driving force upon the impeller 38 before the air is discharged to the atmosphere through the ports 41.

It was thought necessary to provide separate vent means to freely admit air into the reservoir when the compressed air supplied to the impeller chamber was interrupted so that the aspiration of paint from the reservoir would not be impeded. It has been found, however, that if the discharge ports are made with a sufficiently large flow area, the clearance space between the shaft 36 and the bearing 48 will be sufficient to enable reverse flow of atmosphere air through the discharge ports 41 into the chamber 39 and from the chamber 39 through the clearance space of the bore 49 into the reservoir around the fling wheel 42 which is normally spaced-apart from the bearing 48 when the agitator is stationary. Thus when the air supply to the impeller chamber 39 is interrupted, the pressure within the impeller chamber 39 is atmospheric pressure, and because of the clearance, the pressure in the reservoir 16 will also reach atmospheric pressure. The clearance and the pressure regulating mechanism 62 permits sufficient air flow to replace any paint or other coating material aspirated out of the reservoir during operating of the gun.

When air is supplied to the chamber 39, the compressed air elevates the pressure in the chamber. However, the flow area through the discharge ports 41 is substantially greater than the flow area through the clearance space between the shaft 36 and the bearing 48 so that there is only a minimal elevation in pressure within the reservoir 16 because of the elevation of the pressure in the chamber 39.

Figure 4:
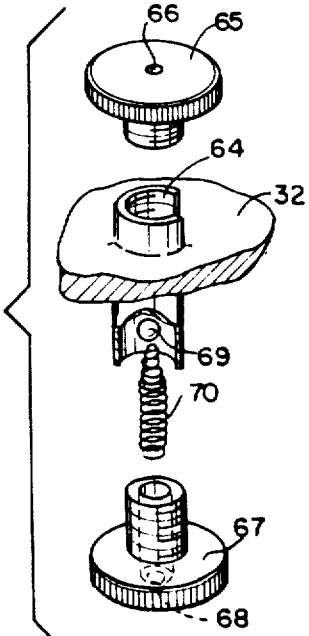
FIG. 4 is a fragmentary exploded view through a portion of the assembly showing the pressure regulating means for the reservoir.

The leakage or spillage which occurs in prior cups results where there is an open passageway from the reservoir and the atmosphere. To eliminate such passageway and yet avoid the adverse effects of excessive pressure changes within the reservoir 16, a pressure regulating assembly is provided at 62, best illustrated in FIG. 4. As shown, the cover member 32 has a tube 64 extending through its wall, preferably diagonally spaced from the aspirator tube 18. The tube has a threaded bore, and a cap screw 65 having a central port 66 closes the top of the bore of the tube 64. A similar screw 67 having a vent port 68 is threaded in the bottom of the tube 64. A ball valve 69 cooperates with the port 66 as a valve seat in the top screw 65 and is biased upwardly by a spring 70 which is held captive by the lower cap screw 67 when the unit is assembled. The spring force of the spring 70 determines the pressure at which the ball 69 unseats from the port 66 and thereby allows air to flow into the chamber when the gun is triggered to minimize any pressure change in the reservoir. The distance between the caps may be adjusted to change the spring force of the spring 70. It is preferred to employ a spring having smaller convolutions where the spring engages the ball 69 to assure proper seating of the ball in the vent opening 66. Thus the pressure regulating device limits the pressure within the reservoir between atmospheric pressure and the pressure determined by the spring 70 while assuring that no spray material leaks from the reservoir. The pressure in the reservoir in any event will be no greater than the pressure in the impeller chamber which is close to atmospheric, because of the clearance space between the shaft 36 and the bearing 48 and the large flow area through the discharge ports 41.

The construction of the pressure regulating mechanism permits easy disassembly of the mechanism for flushing in the event that the mechanism becomes clogged with particles of the coating material which may enter the mechanism due to agitation. In normal operation the pressure device operates to allow air flow down through the tube 64 into the reservoir, the major air flow being inwardly into the reservoir through the ball check valve.

The pressure invention provides for the presence of a limited change of pressure from atmospheric pressure within the reservoir so that the reservoir is maintained at substantially atmospheric pressure throughout its operation, thereby assuring proper aspiration of the coating material through the aspirator tube 18 by normal operation of the spray gun. Inasmuch as the shaft 36 is provided with the fling wheel 42 confronting the lower end of the bearing 48, there is little opportunity for the coating material to escape into the clearance space and into the impeller chamber as the paint cup is manipulated with the spray gun during the operation thereof. The impeller 38 fits loosely within the cylindrical chamber 39 so that upon cut-off of compressed air by the valve 55, there is no impedance to the inward flow of atmospheric air through the ports 41 to the clearance space between the shaft 36 and the bushing 48, which may be supplemented by inward flow through the pressure-regulating mechanism. Consequently the present invention provides a paint cup assembly which is inexpensive to manufacture, may be readily flushed either by filling the reservoir with a solvent and operating the spray gun or else by simple disassembly of the spray cup which is facilitated by the present construction. Even the most unskilled operator cannot disable the assembly beyond simple repair.

While a particular embodiment of the invention has been herein illustrated and described it has not intended to limit the invention to such disclosure but changes and modifications may be made therein and thereto within the scope of the following claims.

I claim:

1. In combination with a hand-held spray gun for spraying paint and other coating materials, a reservoir for said material, aspirator tube means connected to said spray gun and extending to the bottom of said reservoir, a cover assembly mounting said reservoir on said spray gun, said cover assembly including an impeller chamber, an agitator shaft mounting said impeller for rotation in said impeller chamber, and a bushing for said shaft in the bottom of said chamber having a bore open into said reservoir, said shaft extending through said bore into said chamber with sufficient clearance to permit limited air flow therethrough, an air line for feeding compressed air to said gun having a branch conduit for admitting compressed air from said line into said impeller chamber, valve means to regulate the air admitted to said chamber, said impeller chamber having discharge ports in an upper wall to afford primary discharge of said compressed air to atmosphere after driving said impeller, said agitator shaft terminating at its lower end in agitator blades adapted to sweep the bottom of said reservoir, said cover assembly including vent means extending through said cover, communicating said reservoir with the atmosphere, and pressure regulating means in said vent means to maintain the pressure within said reservoir to substantially equal the pressure of the atmosphere.

2. A combination according to claim 1 wherein the discharge ports in said chamber have a flow area substantially larger than the flow area of the said clearance, so that the pressure within said reservoir is substantially less than the pressure of the compressed air admitted to said impeller chamber, said pressure regulating means affording flow of atmospheric air into said reservoir when the pressure in the reservoir falls below atmospheric pressure, whereby the pressure in said reservoir is maintained substantially at atmospheric pressure.

3. A combination according to claim 1 wherein said pressure regulating means comprises a tubular passage, a cap at each end of said passage having a vent opening therein, one of said caps being in the atmosphere and the other being in the reservoir, a ball valve within said passage cooperable with the vent opening of the cap in the atmosphere, and bias means urging said ball to seat against said cap vent opening with a predeterminable pressure.

4. A combination according to claim 3 wherein said bias means comprises a spring compressed between said ball at one end and the reservoir cap at the other end.

5. A combination according to claim 5 wherein said caps are threadedly engaged with said passage, so that screwing one or both of said caps varies the distance between said caps and thereby the compression of said spring and thus the pressure at which said ball valve unseats from said vent opening.

6. In combination with a hand-held spray gun for spraying paint and other coating materials, a reservoir for said material, aspirator tube means connected to said spray gun and extending to the bottom of said reservoir, a cover assembly mounting said reservoir on said spray gun, said cover assembly including an impeller chamber, an agitator shaft mounting said impeller for rotation in said impeller chamber, and a bushing for said shaft in the bottom of said chamber having a bore open into said reservoir, said shaft extending through said bore into said chamber with sufficient clearance to permit limited air flow therethrough, an air line for feeding compressed air to said gun having a branch conduit for admitting compressed air from said line into said impeller chamber, valve means to regulate the air admitted to said chamber, said impeller chamber having discharge ports in an upper wall to discharge said air primarily to atmosphere aftet driving said impeller, said agitator shaft terminating at its lower end in agitator blades adapted to sweep the bottom of said reservoir, said cover assembly including vent means extending through said cover, communicating said reservoir with the atmosphere, and a housing on said cover for said regulating valve means, said housing having a bore opening into said chamber at one end to form an outlet jet admitting air to said chamber, and having a plug at the other end, said regulating valve means controlling the flow of air from said branch conduit into the bore between said outlet jet and said plug.

7. A combination according to claim 6 wherein said plug is removable to afford clearing of said jet opening of any obstruction without disassembly of said housing.

8. A combination according to claim 7 wherein said plug is threaded.

9. In combination with a hand-held spray gun for spraying paint and other coating materials, a reservoir for said material, aspirator tube means connected to said spray gun and extending to the bottom of said reservoir, a cover assembly mounting said reservoir on said spray gun, said cover assembly including an impeller chamber, an agitator shaft mounting said impeller for rotation in said impeller chamber, and a bushing for said shaft in the bottom of said chamber said bushing having a bore open into said reservoir, said shaft extending through said bore into said chamber, an air line for feeding compressed air to said gun having a branch conduit for admitting compressed air from said line into said impeller chamber, and valve means to regulate the air admitted to said chamber, said impeller chamber having discharge ports in an upper wall to discharge said compressed air primarily to atmosphere after driving said impeller, said agitator shaft terminating at its lower end in agitator blades adapted to sweep the bottom of said reservoir, said agitator shaft having a fling wheel mounted thereon immediately below said bushing within said reservoir and extending outwardly in a radial direction from said shaft, said cover assembly including vent means extending through said cover, communicating said reservoir with the atmosphere; said fling wheel comprising a polymeric washer mounted on said shaft and said bushing comprising a polymeric member confronting said washer and providing a low friction engagement limiting upward displacement of said shaft within said bushing.

* * * * *

UNITED STATES PATENT AND TRADEMARK OFFICE

CERTIFICATE OF CORRECTION

PATENT NO. : 4,501,500

DATED : February 26, 1985

INVENTOR(S) : JOSEPH L. TERRELS

It is certified that error appears in the above-identified patent and that said Letters Patent is hereby corrected as shown below:

Column 3, line 61, delete "where" and insert --when--.
Column 4, line 35, delete "pressure" and insert --present--.
Claim 5, line 1, delete "5" and insert --4--.

Claim 6, Col. 6, line 13, delete "aftet" and insert

--after--.

Signed and Sealed this

*Twenty-fourth* Day of *September 1985*

[SEAL]

*Attest:*

DONALD J. QUIGG

*Attesting Officer*

*Commissioner of Patents and Trademarks—Designate*